United States Patent [19]

Duke et al.

[11] 4,384,624

[45] May 24, 1983

[54] EARTH BORING HEAD

[76] Inventors: John W. Duke, 160 Shilds Rd.; John A. Duke, 110 Springview Dr., both of Stockbridge, Ga. 30281

[21] Appl. No.: 238,028

[22] Filed: Feb. 25, 1981

[51] Int. Cl.[3] ..... E21C 9/00

[52] U.S. Cl. ..... 175/19; 175/21; 175/385; 405/184

[58] Field of Search ..... 175/19, 20–23, 175/53, 62, 385, 386, 389; 405/184, 248

[56] References Cited

U.S. PATENT DOCUMENTS

| | | | |
|---|---|---|---|
| 281,868 | 7/1868 | Rhoades et al. | 175/19 |
| 1,639,731 | 8/1927 | Humiston | 175/21 |
| 1,993,365 | 3/1935 | Englebright et al. . | |
| 2,162,108 | 6/1939 | Newman | 405/248 X |
| 2,349,033 | 5/1944 | Elliott | 175/22 |
| 2,664,273 | 12/1953 | Merrick . | |
| 3,805,899 | 4/1974 | Hicks et al. | 175/19 |

*Primary Examiner*—Ernest R. Purser
*Assistant Examiner*—Thuy M. Bui
*Attorney, Agent, or Firm*—Bradford E. Kile

[57] ABSTRACT

An earth boring head comprising a generally conical earth boring member having a forward portion and a rearward portion. At least one aperture is fashioned in a forward portion of the earth boring member for liberating a lubricating fluid around the rearward portion of the conical member as the member is moved through an earth formation. In a preferred embodiment the conical earth boring member is fitted with a generally conical pilot member coaxially mounted in front of the conical earth boring member.

11 Claims, 5 Drawing Figures

FIG. 3
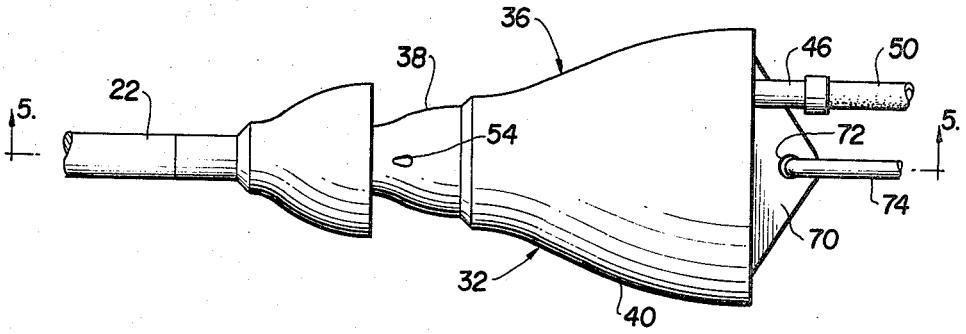
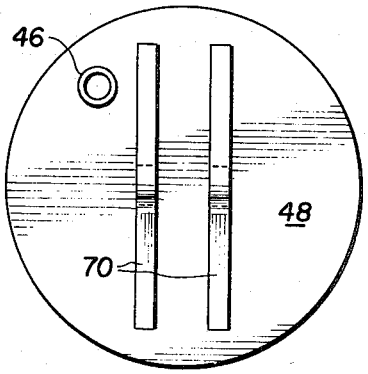
FIG. 4
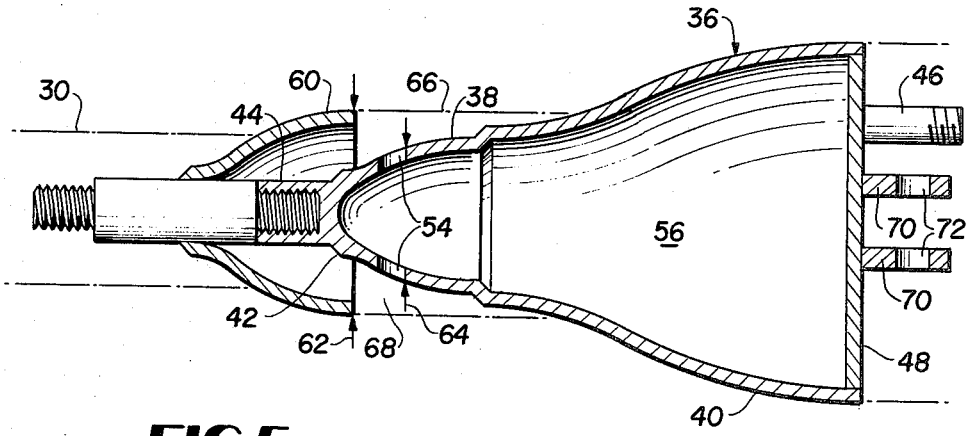
FIG. 5

EARTH BORING HEAD

BACKGROUND OF THE INVENTION

This invention relates to earth boring. More specifically, this invention relates to a head for use with an earth boring machine operable to form generally horizontal passageways for conduits, cables, etc. beneath an established surface such as a roadway or the like without disturbing the roadway surface.

Underground conduits and the like are frequently placed by digging a trench to a desired depth, laying a continuous or articulated conduit within the trench, and then backfilling the trench. In some situations, however, it may be undesirable to utilize conventional pipe laying techniques. In this connection, it can be highly disruptive to traffice patterns to trench across an established roadway. Moreover, after conduit installation is completed, it is necessary to rebuild the roadway surface. This repaired strip is frequently subject to settling and/or wear damage that can create a potential traffic hazard. Further, in areas of high intensity piping such as a chemical processing plant or the like short run elevations in ground surfaces make piping installation by conventional trenching techniques difficult and burdensome.

In the above and other instances, it would be highly desirable to be able to form generally horizontal passageway beneath an established surface without forming a convention vertical trench.

In the past a number of machines have been designed to provide generally horizontal earth passages for relatively short distances. A specific disclosure of a highly advantageous hydraulic earth boring machine may be had by reference to applicants' copending U.S. application Ser. No. 06/151,865 entitled "Hydraulic Earth Boring Machine", filed May 21, 1980. The disclosure of this document is hereby incorporated by reference as though set forth at length. In general terms, however, earth boring machines are mounted within an excavated area or trench adjacent a roadway or the like. A relatively small rod carrying a conical head is then driven by the machine to pierce beneath the roadway surface to an excavated area or trench on the other side of the road. If the first pass does not produce a bore of large enough diameter for the intended purpose an enlarged reverse oriented head is fitted onto the piercing rod and the rod is drawn back through the bore to ream the passageway to a size suitable to receive an underground conduit.

The subject invention is directed to an earth boring head operable to be advantageously used as either a direct piercing head or, more frequently, as a return reaming head.

In the past solid conical bore head members have been frequently utilized. With these units, however, it is difficult to reliably produce a suitable sized bore because of the force necessary to drive the head through the earth. This problem is exacerbated when highly compacted or rocky soil is encountered. Moreover in shallow bores such heads have a tendency to "lump" pavement and crack concrete.

In other instances auger heads have been envisioned. Such units, however, are relatively expensive to produce and maintain and require somewhat sophisticated driving systems.

In another previously known system a slicing return head has been envisioned wherein radial slices are formed in a pilot bore by a return head. A third pass is then made to push the sliced material clear of the passageway.

Finally at least some systems have envisioned injecting water under pressure to cut through an earth formation. Such water boring equipment, however, tends to erratically exode voids in the bore and are frequently disapproved for use by local codes.

The difficulties suggested in the preceeding are not intended to be exhaustive, but rather are among many which may tend to reduce the effectiveness and operator satisfaction with prior earth boring heads. Other noteworthy problems may also exist; however, those presented above should be sufficient to demonstrate that earth boring heads appearing in the past will admit to worthwhile improvement.

OBJECTS OF THE INVENTION

It is therefore a general object of the invention to provide a novel earth boring head which will obviate or minimize difficulties of the type previously described.

It is a specific object of the invention to provide a novel, earth boring head which will exhibit an enhanced capacity to penetrate an earth formation.

It is a further object of the invention to provide a novel earth boring head which will reduce the tendency to "lump" or crack an upper established surface.

It is another object of the invention to provide a novel, earth boring head which does not require an auger action and is relatively inexpensive to fabricate and use.

It is yet another object of the invention to provide a novel, earth boring head wherein large diameter bores may be created with just two passes of the boring equipment.

It is still a further object of the invention to provide a novel, earth boring head wherein the finished bore is smooth and solid and thus facilely capable of receiving an underground conduit or the like.

THE DRAWINGS

Other objects and advantages of the invention will become apparent from the following detailed description of preferred embodiments thereof taken in conjunction with the accompanying drawings, wherein:

FIG. 3 is a side view of a preferred embodiment of the subject earth boring head;

FIG. 4 is an end view of the earth boring head depicted in FIG. 3; and

FIG. 5 is a cross-sectional view taken along section line 5–5 in FIG. 3.

DETAILED DESCRIPTION

Figure 1:
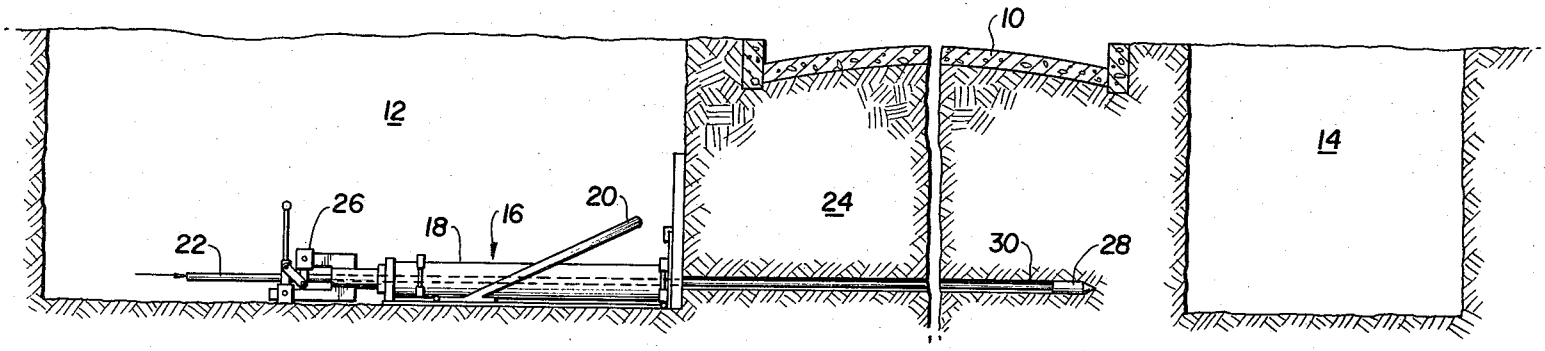
FIG. 1 is a schematic side view, partially broken away, which discloses the formation of a pilot bore beneath an established roadway by an earth trenching machine.
Figure 2:
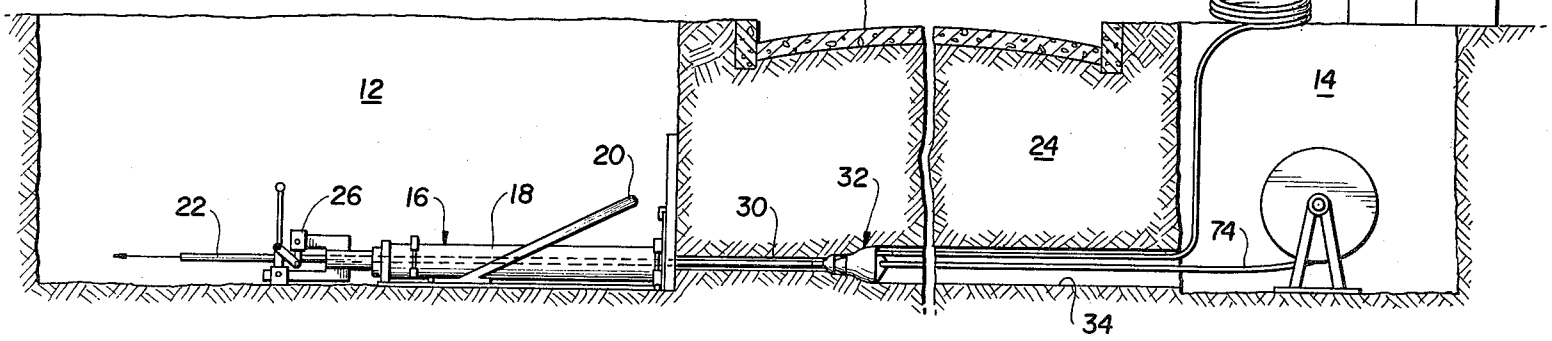
FIG. 2 is a schematic view, similar to FIG. 1 wherein an earth boring head, in accordance with a preferred embodiment invention, is utilized as a back reamer to enlarge a pilot bore formed as depicted in FIG. 1.

Referring now to the drawings and particularly to FIGS. 1 and 2 thereof there will be seen schematic figures which establish the operating context of the subject invention. More specifically FIG. 1 discloses an established surface 10 such as a roadway. An earth boring trench 12 is shown dug out on one side of the roadway and a receiving trench 14 is fashioned on the other side thereof. An earth boring machine 16 is mounted within the first trench 12.

The earth boring machine 16 is described in detail in applicants' previously identified U.S. application Ser. No. 06/151,865. Briefly, however, the earth boring machine includes a hydraulic cylinder 18 which may be elevated to a desired vertical location within the trench by activation of a lifting lever 20. A boring shaft 22 extends coaxially through the hydraulic cylinder 16 and operably projects toward an earth formation 24 beneath the roadway 10. The boring shaft is operably coupled to the hydraulic cylinder 18 by a manually actuatable gripping assembly 26.

In operation a generally solid, small boring head 28 is mounted on a forward end of the drive shaft 22. The gripping assembly 26 is released and the hydraulic cylinder 18 is backed out. The gripping assembly 26 is then engaged and the hydraulic cylinder is actuated to push the boring head 28 into the earth formation the stroke length of the hydraulic cylinder.

The above procedure is repeated until the boring head is pushed into the opposing trench 14 and a pilot bore 30 is established beneath the roadway surface.

For some applications this small bore 30 may be sufficient for the intended purpose. Frequently, however, the pilot bore 30 must be enlarged or reamed in order to accommodate placement of an underground conduit or cable.

Referring now to FIG. 2, backing reaming is accomplished by detaching the pilot head 28 from the forward end of the drive shaft 22 and attaching a reverse oriented reaming head onto the shaft. A reaming head 32, in accordance with the subject invention, is shown in FIG. 2. This reaming head is pulled back through the pilot hole 30 by reverse operation of the hydraulic cylinder 18 and gripping assembly 26 to form an enlarged bore pasageway 34.

Turning now to FIGS. 3–5 there will be seen detail views of the subject earth boring head 32. The boring head 32 comprises a generically conical earth boring member 36 having a forward portion 38 and a rearward portion 40. As can readily be seen from FIGS. 3 and 5 the cross-sectional diameter of the conical member 36 generally increases from the forward portion to the rearward portion thereof.

The apex or nose 42 of the conical earth boring member 36 is fitted with a first attachment member 44 which is operable to be connected to the boring shaft 22 for pulling the boring member 36 through the earth formation. In those instances where the subject earth boring member is utilized to penetrate virgin earth the location of attachment member would be placed on the opposite end to permit pushing action of the bore shaft.

A second attachment member 46 is connected to a rear wall 48 of the conical earth boring member 36. The second attachment member 46 may in turn be connected to a fluid lubrication conduit 50 (note FIGS. 2 and 3). A gravity or low pressure source of lubricating fluid such as oil, water, etc. is stationed beside trench 14 as at 52 and serves to deliver lubricating fluid to the second attachment and earth boring member 36.

Aperatures 54 are fashioned through a forward portion of the conical earth boring member 36 and permit lubricating fluid to be liberated into the bore as the boring member advances through an earth formation. This lubricating fluid does not erode away an earth passageway, but rather facilitates passage of an enlarged boring member through the earth formation 24. In a preferred embodiment of the invention aperatures 54 have a generally tear shaped configuration, note FIG. 3. This shape facilitates spreading of the fluid toward the rear portion 40 of the boring member.

The end wall 48 in combination with a generally hollow character of the boring member 36 serves to form an accumulation chamber 56 for lubricating fluid within the conical earth boring member 36.

Although the conical earth boring head may be utilized alone, as discussed above, in a preferred embodiment of the invention, a generally conical pilot member 60 is coaxially mounted with respect to the earth boring member 36. The diametrical dimension 62 at the base of the pilot head is greater then the diametrical dimension 64 of the forward portion 38 of the conical member 36 at the location of apertures 54. The pilot head will serve to enlarge the pilot bore 30 to a first degree as at 66 which is greater than the diametrical placement of the lubricating aperatures 64. This enlargement will serve to form a chamber 68, exterior of the forward portion 38 of the conical boring member 36 and thus facilitate distribution of the lubricating fluid about the boring member 36 as it is pulled through the earth formation.

The base 48 of the conical bore head 36 may also be fitted with one or more flanges 70 having aperatures 72 to permit attachment of a pipe or cable 74 to be pulled through the bore behind the subject earth boring head 32, note again FIG. 2.

While the subject pilot and boring members have been described in the foregoing as a reamer designed to be pulled through a pilot hole it should also be understood that the subject boring head may be pushed through virgin earth to form an original bore hole.

BRIEF SUMMARY OF MAJOR ADVANTAGES OF THE INVENTION

After reading and understanding the foregoing description of preferred embodiments of the invention, in conjunction with the drawings, it will be appreciated that several distinct advantages of the subject earth boring head are obtained.

Without attempting to set forth all of the desirable features of the instant invention, as specifically and inherently disclosed above, at least some of the major advantages includes the provision of a fluid lubrication to an earth boring process. The lubricating aperatures are tear drop shaped to facilitate distribution of the lubricating fluid around the earth boring member.

The cavity 56 serves to accumulate lubricating fluid and the pilot head is dimensioned to form a chamber between an advancing forward portion of the boring member 36 and a surrounding bore passageway. This exterior chamber again facilitates distribution of the lubricating fluid.

The subject lubricating medium in combination with the subject conical bore member reduces friction and drag of the head through an earth formation. Accordingly larger bores can be created without an increase in driving force. At the same time it has been found that the tendency to "lump" or crack an established surface has been minimized. Finally the bore hole produced by the subject lubricated system creates a smooth, compact passageway substantially as smooth as an underground conduit. This greatly facilitates placement of cables and the like in the bore.

In describing the invention, reference has been made to preferred embodiments and illustrative advantages of the invention. Those skilled in the art, however, and familiar wth the instant disclosure of the subject invention may recognize additions, deletions, modifications, substitutions and/or other changes which will fall within the purview of the subject invention and claims.

We claim:

1. An earth boring head for forming a passageway through an earth formation beneath an established surface such as a roadway, walkway or the like, said earth boring head comprising:

a generally concial earth boring member having a forward portion and a rearward portion wherein the cross-sectional diameter of said conical member generally increases from said forward portion thereof to said rearward portion thereof;

first attachment means connected to said conical member for operably connecting said conical member to a shaft of an earth boring machine operable to move the conical member through an earth formation;

second attachment means connected to said conical member for receiving a fluid lubrication conduit operable to deliver a fluid lubrication medium to said conical member; and at least one aperature formed through said forward portion of said conical earth boring member for liberating a lubricating fluid around the rearward portion of said conical member as the conical member is moved through an earth formation to facilitate movement of the conical member through the earth formation and form of a smooth bore hole.

2. An earth boring head for forming a passageway through an earth formation as defined in claim 1 and further comprising:

an internal cavity fashioned within the interior of said conical member for accumulating lubricating fluid within said conical member before it is issued through said at least one aperature in said forward portion of said conical member.

3. An earth boring head for forming a passageway through an earth formation as defined in claim 2 wherein:

said at least one aperature in said conical member comprises at least two aperatures generally diametrically spaced from one another.

4. An earth boring head for forming a passageway through an earth formation as defined in claim 1 wherein:

said at least one aperature is generally shaped in a tear drop configuration with an enlarged portion extending toward said rearward portion of said conical earth boring member.

5. An earth boring head for forming a passageway through an earth formation as defined in claim 1 and further comprising:

a generally conical pilot member coaxially mounted in front of said conical earth boring member.

6. An earth boring head for forming a passageway through an earth formation as defined in claim 5 wherein:

said generally conical pilot member has a diametrical base dimension greater than the diameter of said forward portion of said conical earth boring member at the axial location of said at least one aperature such that said conical pilot member will operably form a passageway through an earth formation greater in diameter than the diameter of said forward section of said earth boring member at the location of said at least one aperature to form a chamber to facilely receive lubricating fluid between the exterior of the forward portion of said earth boring member and the earth formation.

7. An earth boring head for forming a passageway through an earth formation as defined in claim 5 and further comprising: attachment means connected to an apex of said generally conical pilot member for connecting said pilot member to a shaft of the earth boring machine such that thw pilot member and earth boring member may be drawn through a previously established pilot passageway to ream an enlarged passageway through the earth formation.

8. An earth boring head for reaming an enlarged passageway through an earth formation beneath an established surface such as a roadway, walkway or the like, said earth boring head comprising:

a generally conical reaming member having a forward portion and a rearward portion;

at least one aperature formed through said forward portion of said conical reaming member for liberating a lubricating fluid around said reaming member as it is moved through an earth formation; and a generally conical pilot head coaxially connected to the apex of said conical reaming member and being operable to precede said conical reaming member through a previously fashioned pilot passageway, said generally conical pilot head has a diametrical base dimension greater than the diameter of said forward portion of said conical reaming member at the axial location of said at least one aperature such that said conical pilot head will operably form a passageway through an earth formation greater in diameter than the diameter of said forward portion of said conical reaming member at the axial location of said at least one aperature to form a chamber to facilely receive lubricating fluid between the exterior of said forward portion of said reaming member and the earth formation.

9. An earth boring head for reaming an enlarged passageway through an earth formation as defined in claim 8 and further comprising:

an internal chamber fashioned without the interior of said conical reaming member for collecting the lubricating fluid before it is issued through said at least one aperature formed through said forward portion of said conical reaming member; and attachment means connected to the base of said generally conical reaming member for receiving a fluid lubrication conduit operable to deliver a fluid lubrication medium to said internal chamber.

10. An earth boring head for reaming an enlarged passageway through an earth formation as defined in claim 8 and further comprising:

attachment means connected to an apex of said generally conical pilot member for connecting said pilot member to a shaft of an earth boring machine such that the pilot member and earth boring member may be drawn through a previously established pilot passageway to ream an enlarged passageway through the earth formation.

11. An earth boring head for reaming an enlarged passageway through an earth formation as defined in claim 8 wherein:

said at least one aperature is generally shaped in a tear drop configuration with an enlarged portion extending toward said rearward portion of said conical earth boring head.

* * * * *